US005196822A

United States Patent [19]

Gallusser et al.

[11] Patent Number: 5,196,822

[45] Date of Patent: Mar. 23, 1993

[54] STACKED TERMINATION RESISTANCE

[75] Inventors: David O. Gallusser, Oneonta; Jon P. Bixby, Endicott; James B. LeBaron, Sidney, all of N.Y.

[73] Assignee: Amphenol Corporation, Wallingford, Conn.

[21] Appl. No.: 805,655

[22] Filed: Dec. 12, 1991

[51] Int. Cl.[5] ..... H01C 1/14

[52] U.S. Cl. ..... 338/328; 338/66; 338/214; 338/322

[58] Field of Search ..... 338/328, 214, 66, 322, 338/325

[56] References Cited

U.S. PATENT DOCUMENTS

| | | | |
|---|---|---|---|
| 2,698,372 | 12/1954 | Patla | 201/67 |
| 2,758,183 | 8/1956 | Canegallo | 201/63 |
| 2,878,356 | 3/1959 | Risk | 201/67 |
| 2,899,665 | 8/1959 | Cowles | 338/325 |
| 3,227,983 | 1/1966 | Braun | 338/21 |
| 3,636,493 | 1/1972 | Caddock | 338/52 |
| 3,801,950 | 4/1974 | Wise | 338/66 |
| 3,813,643 | 5/1974 | Hartz | 338/214 X |

FOREIGN PATENT DOCUMENTS

WO84/04426 11/1984 PCT Int'l Appl. .

*Primary Examiner*—Marvin M. Lateef

*Attorney, Agent, or Firm*—Bacon & Thomas

[57] ABSTRACT

A resistance stack for terminating a data bus cable includes a stack of resistor chips, each having two conductively plated through holes. The resistance elements are kept in alignment and electrically connected to leads of the data bus cable by elongated members extending through the through holes. The elongated members may be discrete conductive rods, or soldered and pretinned leads of the cable. To facilitate assembly, solder preforms are provided between each of the resistor chips. The resistance stack is enclosed in a package which includes a cylindrical shell, a cable clamp, a cable strain relief member, and an end cap including a track for accommodating extensions of the elongated members beyond the last resistor in the stack, thereby aligning the elongated members. The package may be both electrically shielded and environmentally sealed.

16 Claims, 12 Drawing Sheets

STACKED TERMINATION RESISTANCE

BACKGROUND OF THE INVENTION

1. Field of the Invention

This invention relates to electrical resistance components, and more particularly to an electrical resistance component of the type conventionally used for termination of a data bus cable.

2. Description of Related Art

It is well known to use resistance elements for the purpose of terminating a data bus cable. The use of resistance elements at the termination of the data bus line prevents reflection of energy back up the line by providing a load impedance which matches the characteristic impedance of the line, thus permitting transmission of high frequencies with a minimum of loss. Conventionally, such termination resistances are formed from resistor chips bonded to wires of the cable by direct soldering of the wires to slots in the chips. The wires are prepared by stripping the cables and pre-tinning the wires to form leads suitable for supporting the resistor chips.

Such conventional cable termination arrangements are subject, however, to axial misalignment of the stack of resistor chips, and to separation of the cables and leads from the chips. Although numerous different arrangements are presently used for stacking and aligning resistance elements in contexts other than cable termination, none has proved completely satisfactory in the specific context of cable termination.

Furthermore, in addition to the problems of misalignment and lack of mechanical integrity, conventional stacked termination resistance components often lack shielding and environmental sealing arrangements suitable for use in the context of data bus termination. Current packaging arrangements have tended to be both unwieldy and excessively costly to manufacture.

SUMMARY OF THE INVENTION

The present invention seeks to provide an alternative to direct soldering of cable leads to slots in cable termination resistance elements and an alternative to using stripped and pretinned wires of the cables themselves as the conductors to which the resistor chips are electrically bonded.

To accomplish these objectives, the invention calls for the formation of precision plated through-holes in a stack of resistor chips, the through-holes providing an electrical and structural interface between the conductors and the chips.

In the alternative embodiment of the invention, the conductors include conductive rods which are used in place of conventional stripped and pretinned cable leads, the conductive rods being separately bonded to the wires of a data bus cable through a variety of known bonding methods.

The present invention also provides an improved packaging arrangement which offers both an electrical shield and an environmental seal, and which is implemented in an especially simple and convenient-to-manufacture manner by eliminating complicated and expensive fixturing while permitting use of automated soldering techniques in lieu of hand soldering.

DETAILED DESCRIPTION OF THE PREFERRED EMBODIMENTS

Figure 1:
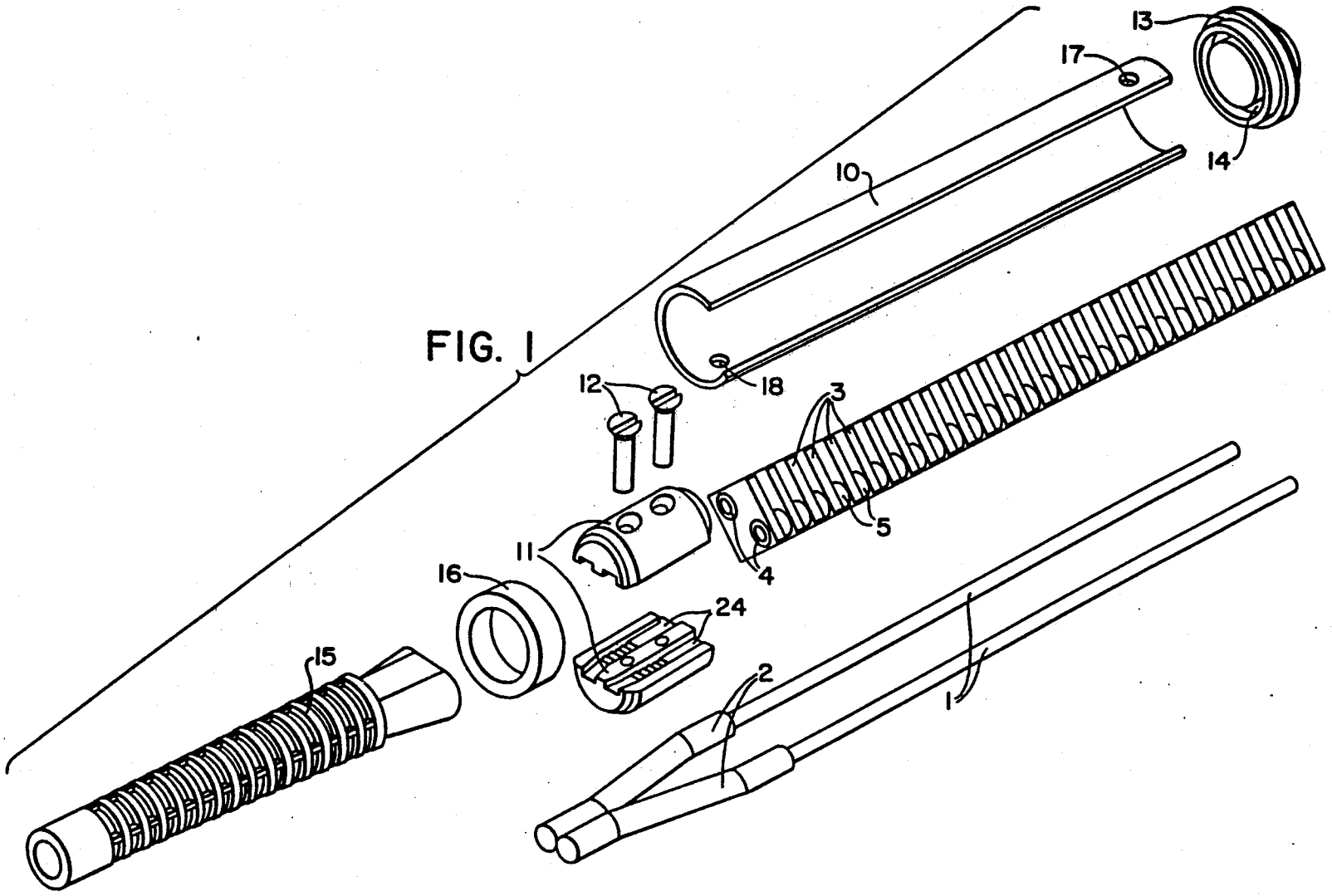
FIG. 1 is a perspective view of the unassembled parts which make up a cable termination resistance stack assembly according to the preferred embodiment of the invention.

In accordance with a first embodiment of the invention, a stacked termination resistance assembly 100 includes a pair of leads 1; the outer jackets 2 of individual wires of the cable being stripped back, as is best shown in FIG. 1, to expose the wires and thereby form leads 1. The leads may be formed from either single wires or from twisted together and pre-tinned multiple wires of the cable.

It will be appreciated, of course, that the invention is applicable to electrical transmission lines other than data busses. Termination is a necessity whenever information is carried by a finite transmission line, whether in the form of an amplitude or frequency modulated signal, or encoded pulses. However, the invention is especially suited for computer system data bus cables.

Figure 8:
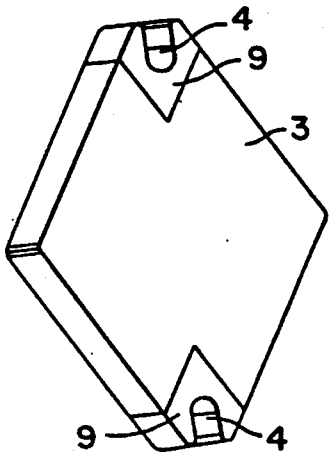
FIGS. 6–8 are perspective views of alternative chip configurations for the assembly of FIGS. 2–5.
Figure 7:
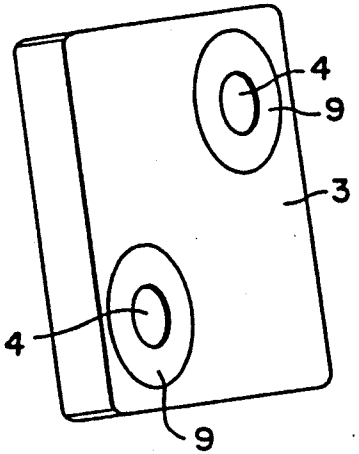
Figure 6:
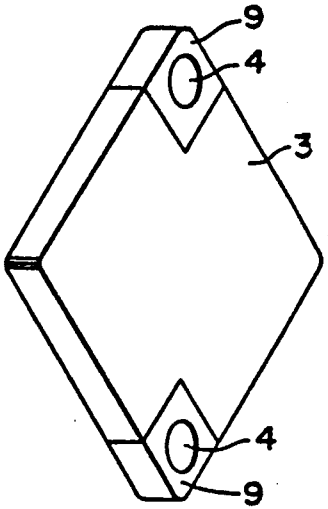

The ceramic resistor chips 3 which make up stack 101 may have a variety of configurations, as shown in FIGS. 6–8, but each includes a pair of conductively plated through-holes or substantially closed openings 4 into which the cable leads are inserted, and which function to provide positive alignment between the individual chips and the leads and to prevent separation of the leads from the chips. In order to provide the necessary structural support, the walls of the openings should engage the leads over an angle of greater than 180°.

Between the resistor chips 3 are located solder preform washers 5 which may be cylindrical or comprised of pairs of frustoconical sections, and which are threaded onto the leads 1 to facilitate electrical connection between the conductive plating 9 on the openings and the leads.

Figure 10:
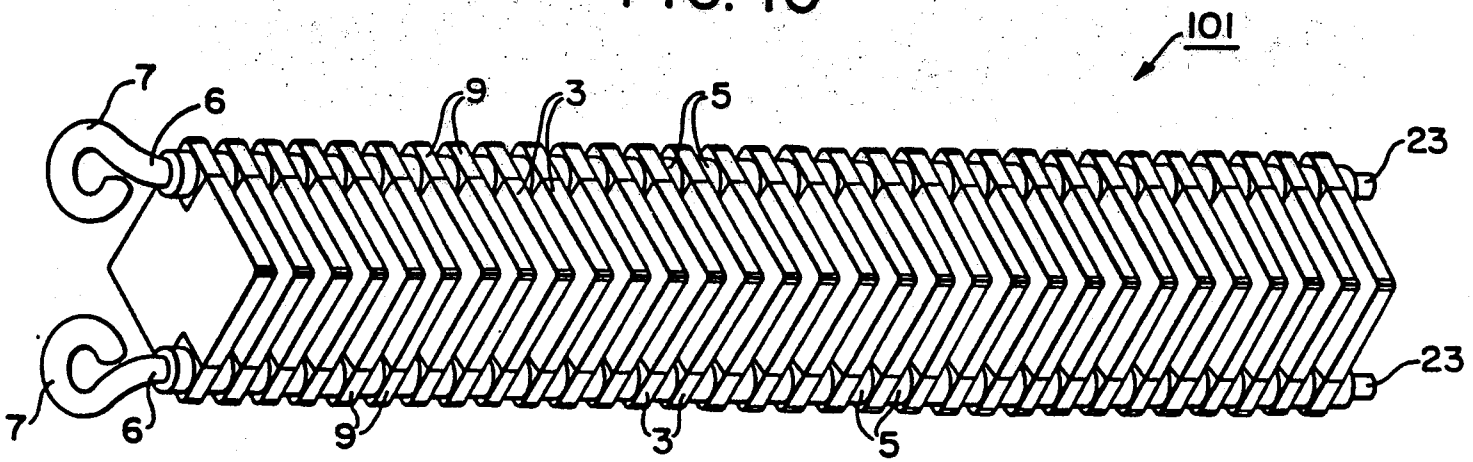
FIG. 10 is a perspective view of a resistance stack made up of the parts shown in FIGS. 6 and 9.
Figure 11:
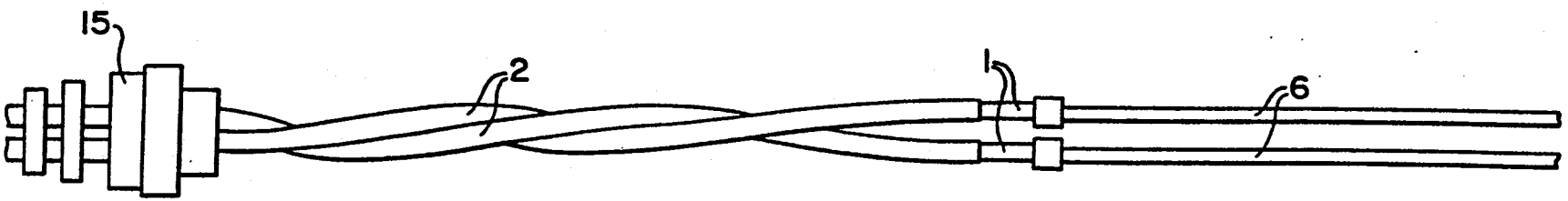
FIG. 11 is a plan view of another alternative to the assembly shown in FIGS. 2–5.
Figure 12:
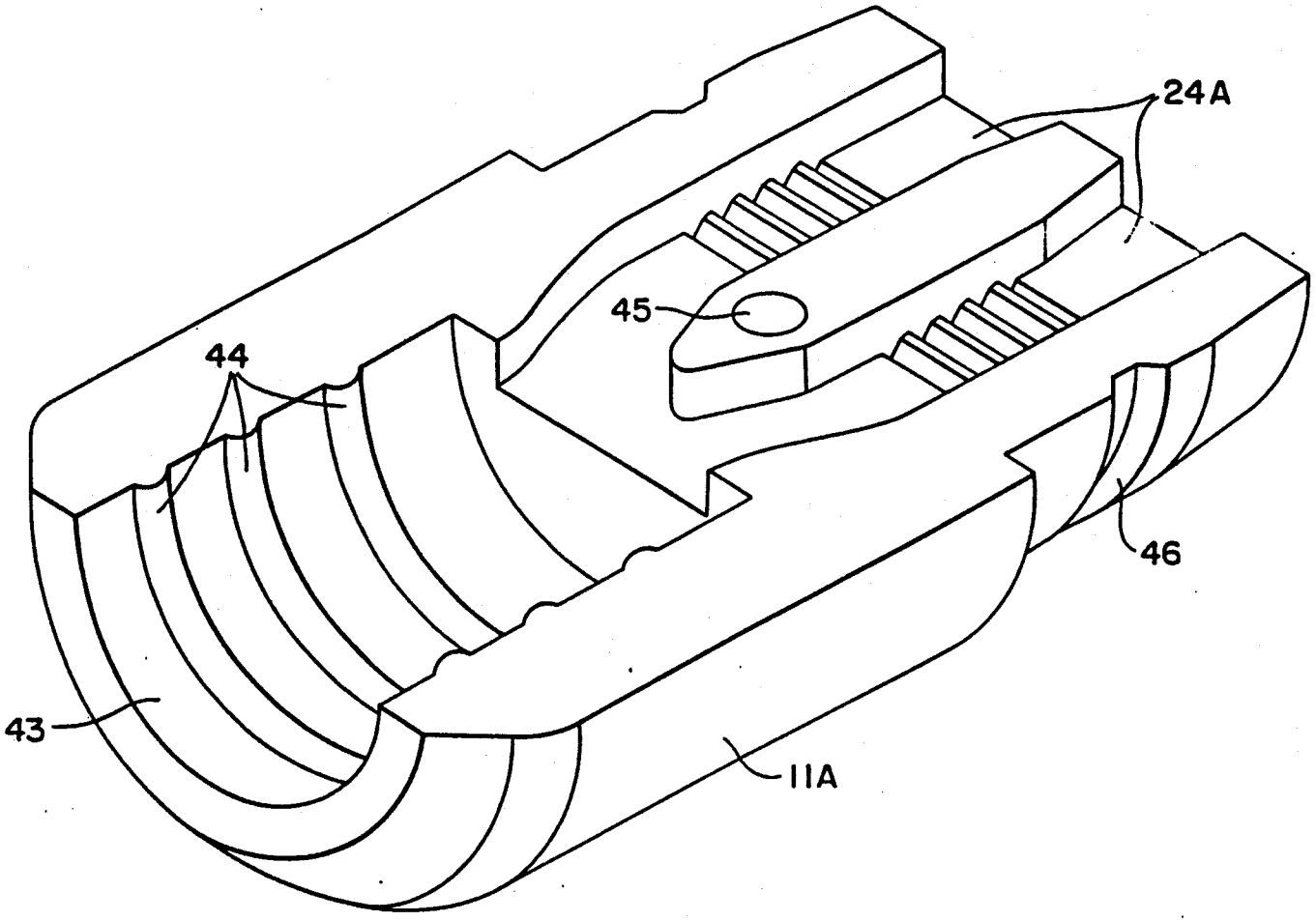
FIG. 12 is a perspective view of a clamping member according to a preferred alternative embodiment of the invention.

An alternative embodiment of the invention is shown in FIGS. 10 and 11. In this embodiment, instead of pretinned wires, the leads of the resistance stack are formed by conductive rods 6. As shown in FIG. 10, the conductive rods 6 include eyelets 7 for facilitating attachment to the wires of a data bus or cable 8. The rods may be attached to the cable leads via an electrical bond using such known welding techniques as laser, electrobond, arc, or percussion welding. Rods 6 provide a mechanically more secure support for the chips than do the above-described pre-tinned leads, and simplify the assembly process by eliminating the step of pre-tinning, permitting pre-assembly of the resistance stack prior to attachment of the cable.

Figure 2:
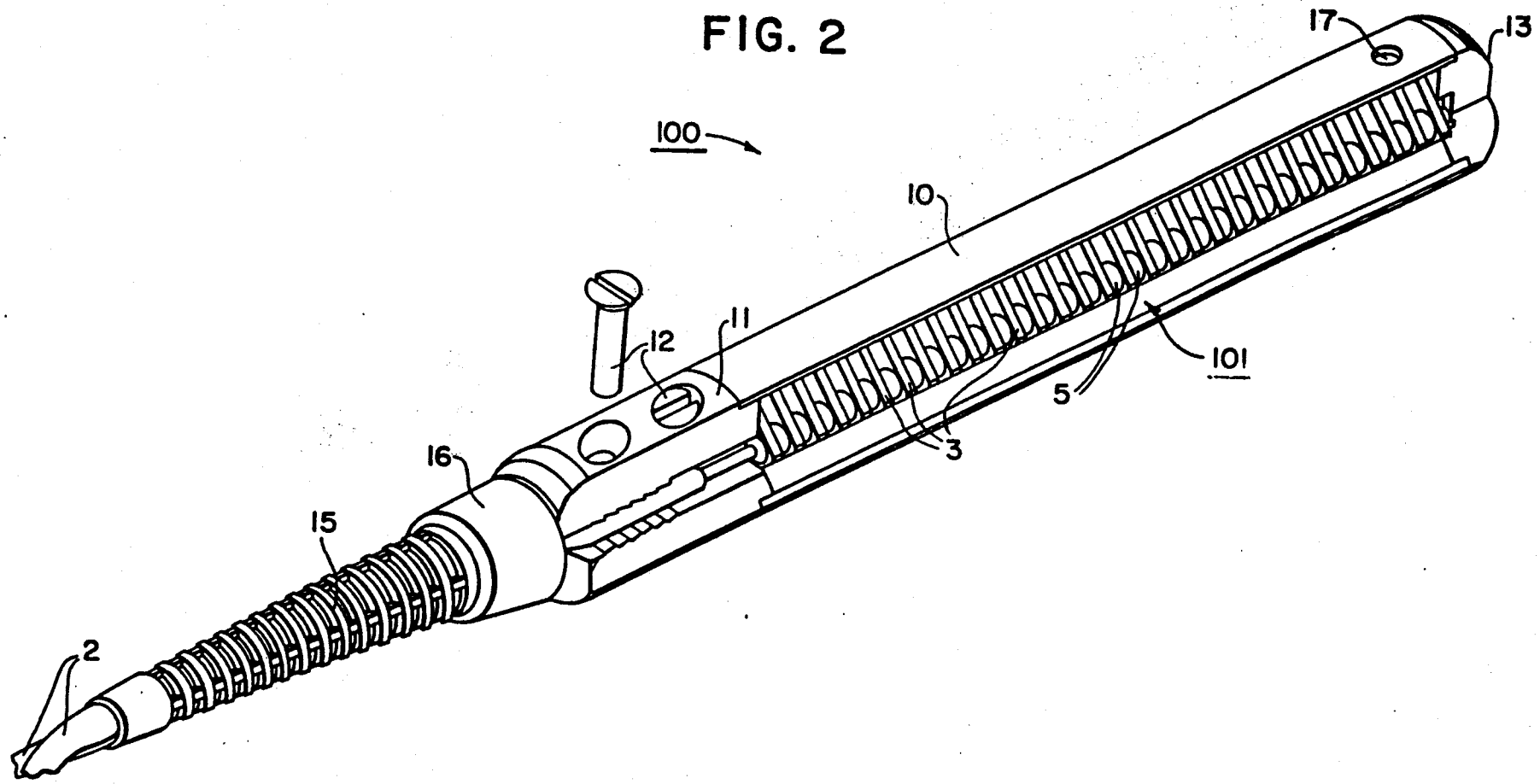
FIG. 2 is a cut-away perspective view of a preferred termination assembly using the parts shown in FIG. 1.
Figure 3:
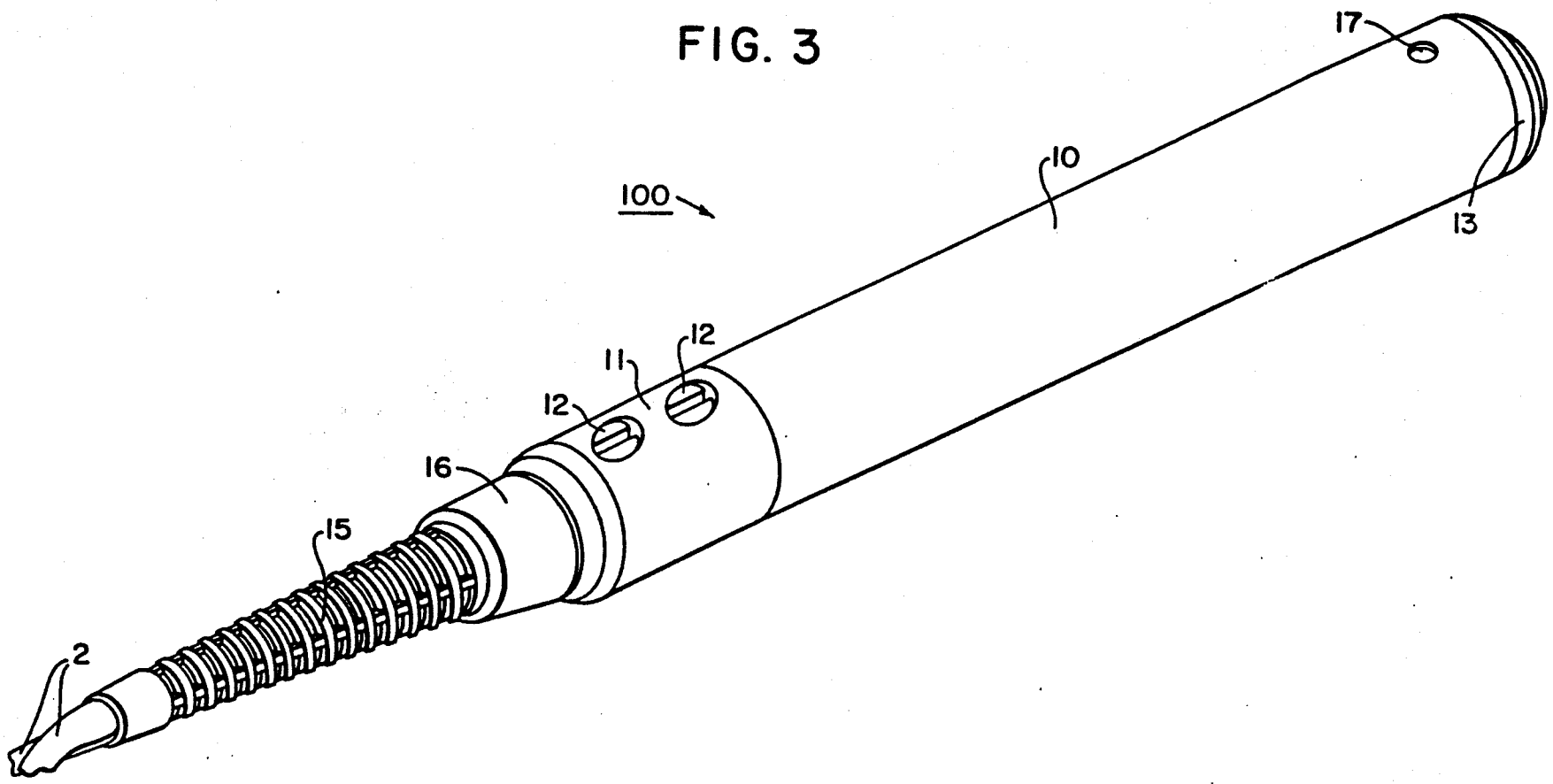
FIG. 3 is a perspective view showing the assembly of FIG. 2.

As shown in FIGS. 1 and 2, the stack termination resistance assembly of the invention is preferably provided with a tubing shell 10 in the form of a cylindrical conductive metallic encasement for mechanical strength and EMI shielding. Alternatively, shell 10 may be in the form of a non-conductive metal or non-metallic encasement for prevention of bending or physical damage, additional EMI shielding being optionally applied as described below.

The resistance assembly further includes a non-metallic cylindrical strain relief clamp 11, which include slots 24 for accommodating cable jackets 2 and which is depicted for clarity in FIG. 2 as being cut away. Fastening hardware 12 for clamp 11 may include screws with standard slotted heads, as illustrated, although those skilled in the art will appreciate that a variety of other mounting hardware elements may also be used with the preferred strain relief clamping arrangement.

An end cap 13 with a slotted track 14 is provided for accommodating wire or conductive rod tips 23 beyond the last resistor chip in the stack. End cap 13 serves to center and parallelly align the cable leads or conductive rods, and may be made of the same material as strain relief clamp 11. Tapering of end cap 13 may be added for cosmetic purposes as is best shown in FIG. 2.

The termination resistance assembly also includes a flexible strain relief 15 for the wires, attached to clamp 11 by a ringlet 16 of heat shrink tubing material which is used to increase the shoulder diameter of the strain relief when additional shielding and sealing is applied to tubing shell 10 and clamp 11. The ringlet 16 of heat shrink tubing material is secured (heat shrunk) onto the outside of the flexible strain relief, filling the diametric gap in transition between the flexible strain relief and the clamped set 11. Insulation foam is then preferably injected through a hole 17 in the shell tubing to insulate the resistor chip assembly from mechanical shocks. Venting and overflow of the insulation foam are accommodated by providing a second hole 18 in the shell tubing.

Figure 4:
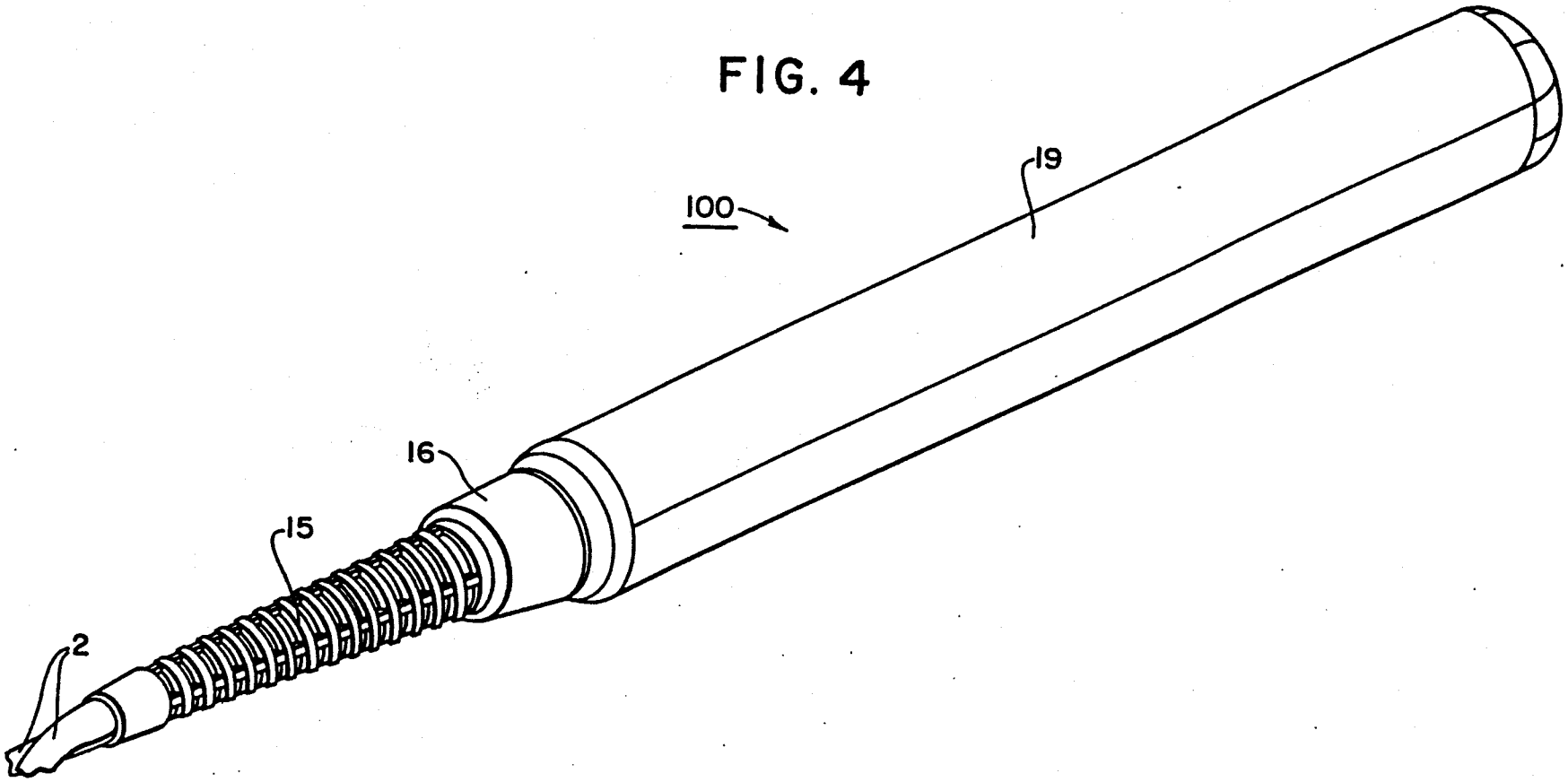
FIG. 4 is a perspective view of the assembly of FIG. 3, including alternate additional electrical shielding.

In case the shell tubing is non-metallic, EMI shielding tape 19 is applied over the non-metallic shield tubing to offer a full range of electro-magnetic interference shielding, as shown in FIG. 4. The shielding tape 19 is overlapped as needed to conform to the shape of the cosmetically tapered end cap 13.

Figure 5:
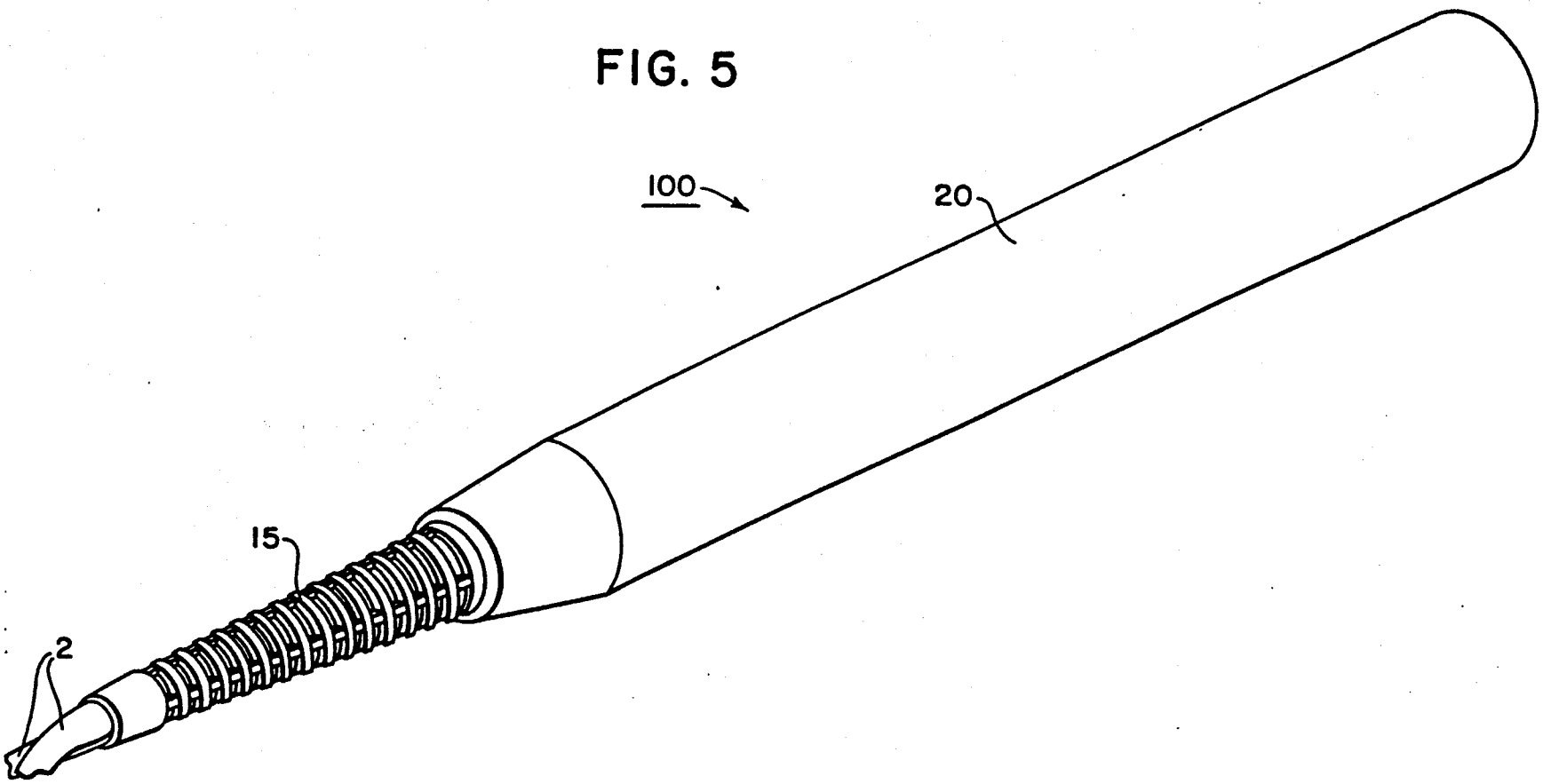
FIG. 5 is a perspective view of the assembly of FIG. 3, including an environmentally protective seal.
Figure 9:
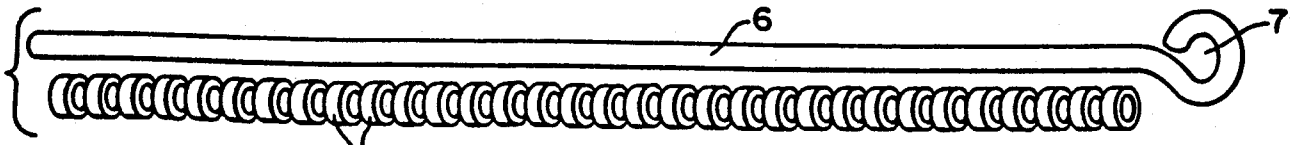
FIG. 9 is a perspective view of the unassembled parts which make up an alternative resistance stack for the assembly of FIGS. 2–5.
Figure 16:
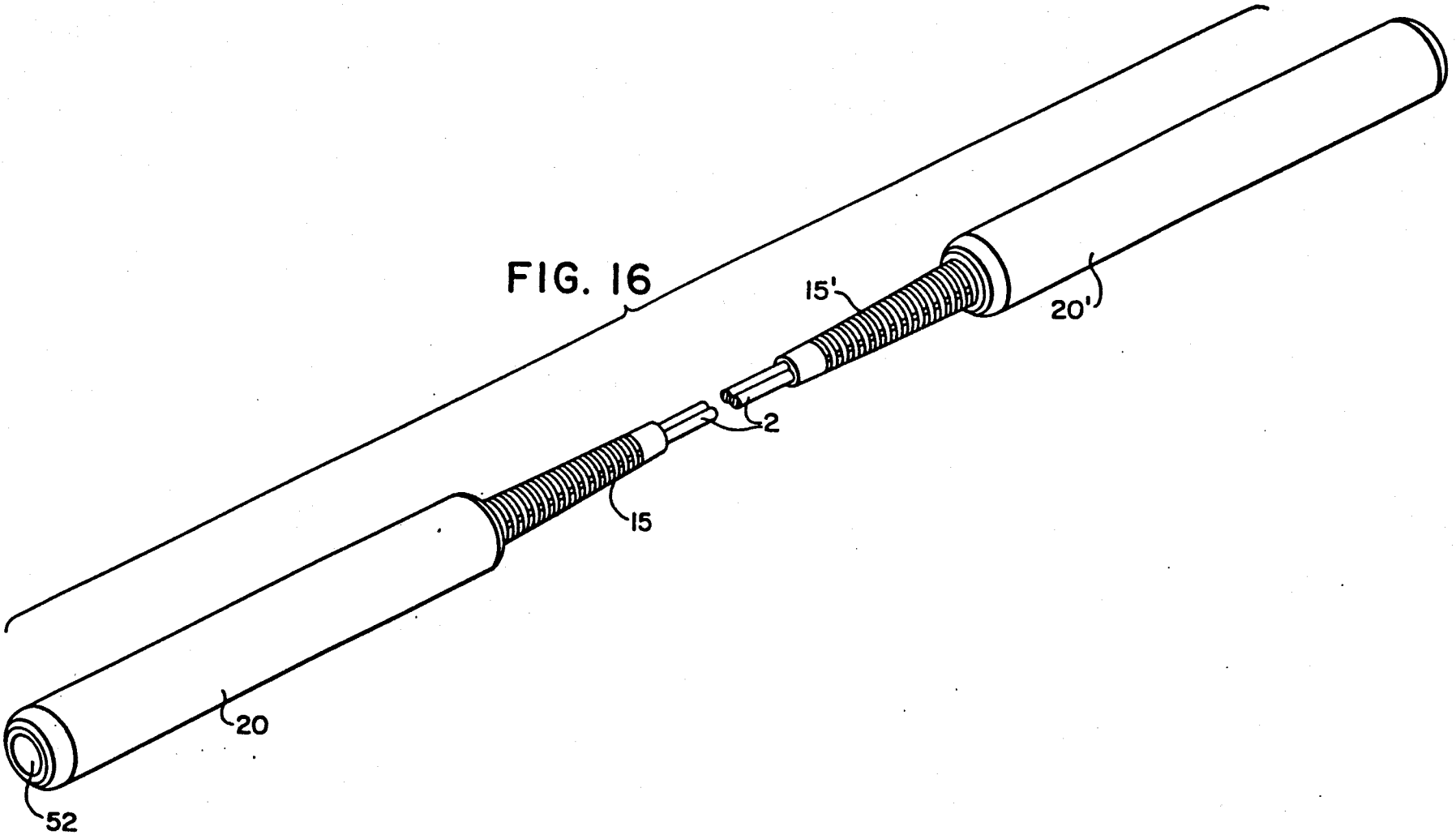
FIG. 16 shows a cable or data bus terminated at both ends and including a potted environmentally protective seal.

Finally, the shielded resistor chip sub-assembly is preferably conformal coated with an environmentally protective shielding barrier 20, as shown in FIGS. 5 and 16. In FIG. 16, the shielding barrier has been added to termination assemblies at both ends of the cable, the strain relief at the second end being designated by the reference numeral 15' and the second shielding barrier by 20'. The shielding barriers may be achieved through molding or by applying heat shrink tubing with an appropriate adhesive or sealing additive, or lining. Optionally, the end of the shielding barrier shrink tubing may be filled beyond the end cap with high temperature molding rubber-type compounds 52, and trimmed cosmetically as shown in FIG. 16.

In order to manufacture the cable termination of the preferred invention, openings 4 are formed in the chips and precision plated with conductive material 9. A stack of the prepared resistance elements is inserted over stripped and pretinned leads 1 or rods 6, with intervening solder preform washers 5. Washers 5 are then heated to electrically bond the leads or rods to the plating material 9. In order to facilitate assembly of the stack, a holder may be used to align the chips while the leads are added and soldered.

The preformed stack is then inserted into shell 10, the wires are secured by clamp 11, ringlet 16, and strain relief 15, and the stack is further secured and held in axial alignment by end cap 13, which is attached to shell 10 by any suitable mechanical attachment means. Insulation foam is then injected into hole 17, and the assembly is subsequently electrically shielded with shielding tape 19 in the case of a non-conductive or non-metallic shell. Finally, the assembly is environmentally sealed, completing the assembly.

An alternative strain relief clamp 11*a* and end cap 13*a* are depicted in FIGS. 12–15. In this embodiment, the need for ringlet 16 has been eliminated by providing an acceptance cavity 43 in the strain relief clamp 11*a*. Also, fastening hardware 12 is eliminated by the use of an alignment pin 47, and the tube 10 has been extended to overlap the strain relief clamp 11*a*. Tube 10 is held in place by rolling material into a groove 46. The end cap 13*a* has been further modified to be held in place by the rolling of material into the groove 31. This embodiment is preferred because of the added simplicity resulting from the use of fewer components. The resistance assembly of FIGS. 12–15 includes a non-metallic cylindrical strain relief clamp 11*a*, which includes slots 24*a* for accommodating cable jackets 2, flexible strain relief boot cavity 43 with gripping features 44, alignment pin hole 45, and staking engagement groove 46.

Figure 13:
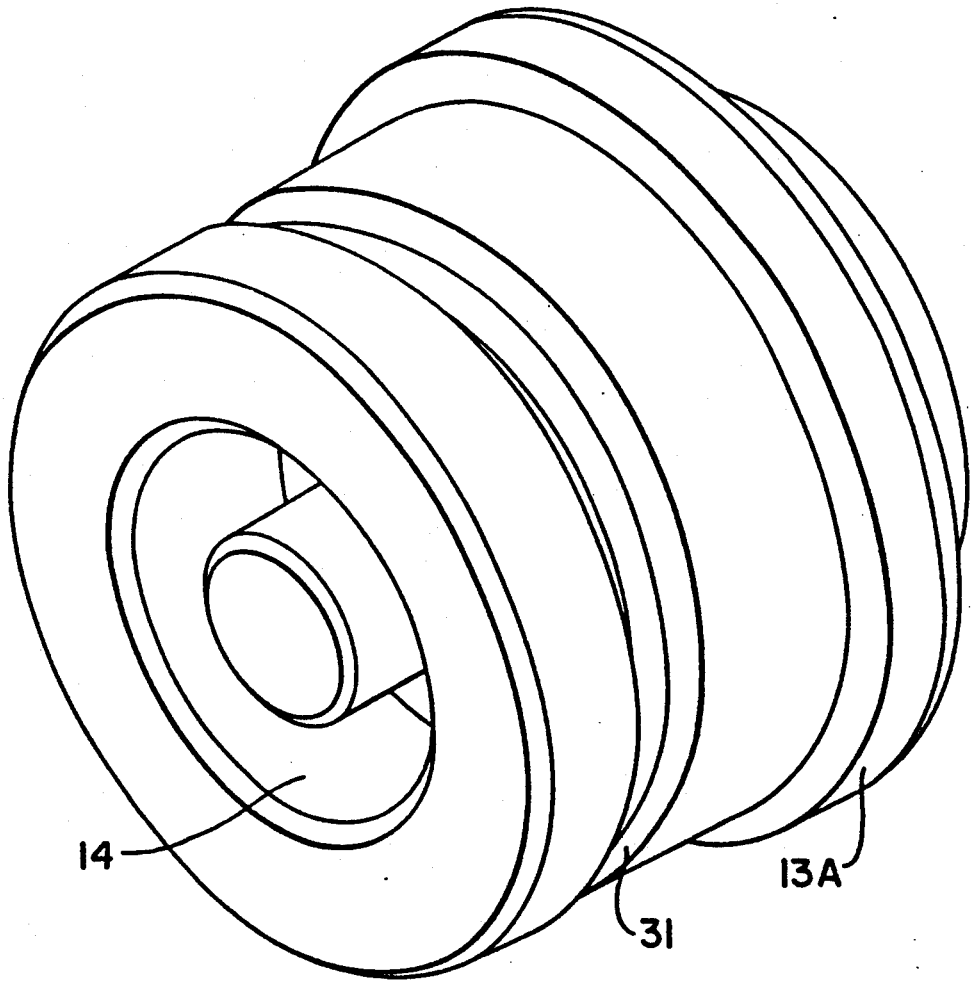
FIG. 13 is a perspective view of an end cap according to the preferred alternative embodiment of the invention.

An end cap 13*a* with a slotted track 14 is provided for accommodating wire tips 1 beyond the last resistor chip in the stack. An additional feature used in securing the end cap 13*a* to tubing shell 10 is the staking engagement groove 31 as depicted in FIG. 13.

Figure 14:
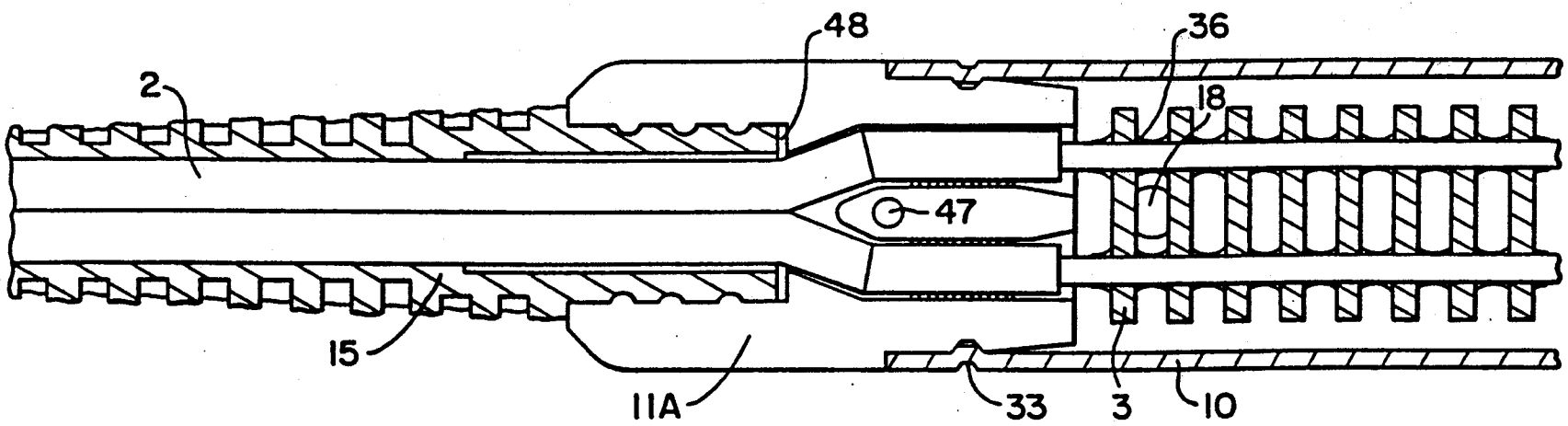
FIG. 14 is a cross-sectional side view of the manner in which the clamp of FIG. 12 is used in connection with a shell and cable strain relief member.
Figure 15:
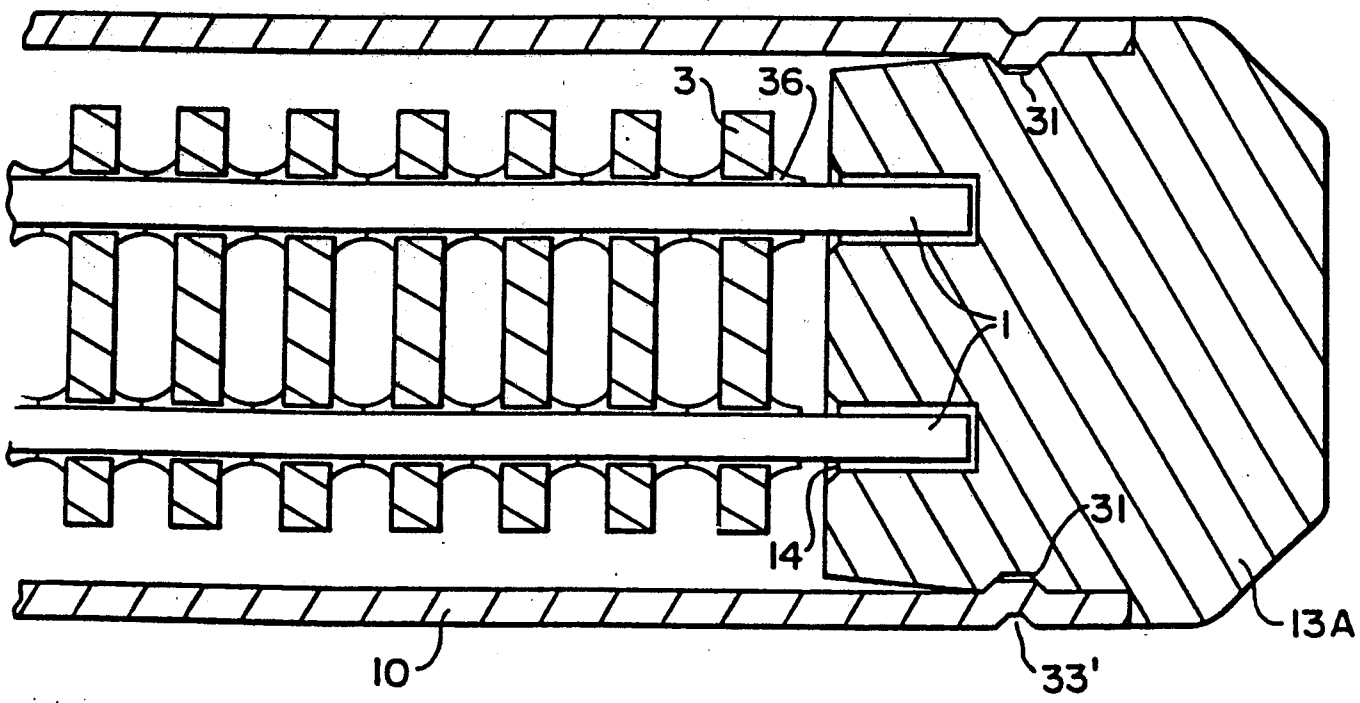
FIG. 15 is a cross-sectional side view of the end cap of FIG. 13 as used in connection with a shell.

In this embodiment, the resistance assembly includes bonding of the interfacial surfaces of the flexible strain relief boot 15 and wire jackets 2, bonding of the mating surfaces of the cylindrical clamp halves 11*a* and the tracks 24*a* in the clamp 11*a* with the wire jackets 2, and bonding of the tubing shell 10 with the engagement groove 33 of clamp 11*a*. In addition, the interfacial surfaces of the engagement groove 31 of the end caps 13*a* and the inner surface of the tubing shell 10 are bonded. The assembly of this embodiment is assembled by slip fitting and then clamping and staking along the shell's surface at 33 and 33' as depicted in FIGS. 14 and 15, after which shielding tape 19 and a shielding barrier 20 may be applied in the manner depicted in FIGS. 4, 5, and 16.

It will of course be appreciated by those skilled in the art that numerous variations of the above-identified embodiments are possible within the scope of the invention including, for example, the use of more than two leads or conductive rods and uses in contexts other than cable termination and, consequently, it is intended that the invention not be limited to the described embodiments, but rather that it be limited solely by the appended claims.

I claim:

1. A resistance stack component for termination of an electrical cable, comprising:

a plurality of electrical resistance elements, including at least two openings in each of said elements and means for conductively plating said openings; and elongated conductive members electrically connected to one of each of said conductive plating means, wherein walls of said openings substantially surround said elongated conductive members to engage said members over an angle of greater than 180°, said walls thereby serving to support and align said members with respect to said resistance elements.

2. A resistance stack component as claimed in claim 1, wherein said resistance elements are ceramic resistor chips.

3. A resistance stack component as claimed in claim 1, wherein said at least two openings consist of only two openings.

4. A resistance stack component as claimed in claim 1, further comprising means including a plurality of solder preforms, each surrounding said elongated members and sandwiched between a respective pair of resistance elements for electrically connecting said elongated members to respective conductive plating means.

5. A resistance stack component as claimed in claim 1, wherein said elongated members are conductive rods electrically connected at one end to leads of a data bus cable.

6. A resistance stack component as claimed in claim 1, wherein said elongated members are soldered and pretinned wires of a data bus cable.

7. A resistance stack component as claimed in claim 1, wherein said openings comprise through-holes in said resistance elements, said walls of said openings completely surrounding said elongated members.

8. A resistance stack component as claimed in claim 1, further comprising means for enclosing said resistance stack, said enclosure means comprising a metallic shell.

9. A resistance stack component as claimed in claim 1, further comprising means for enclosing said resistance stack, said enclosure means comprising a non-conductive shell.

10. A resistance stack component as claimed in claim 9, further comprising means including shielding tape for electrically shielding said resistance stack.

11. A resistance stack component as claimed in claim 1, wherein said elongated members are connected to leads of a data bus cable, and further comprising a cable strain relief member attached to means including a shell for enclosing said resistance stack.

12. A resistance stack component as claimed in claim 1, further comprising enclosure means for enclosing said resistance stack, said enclosure means including a cable clamp, a cylindrical shell surrounding said resistance stack, and an end cap at a second end of said shell.

13. A resistance stack component as claimed in claim 12, wherein said end cap includes a slotted track for accommodating tips of said elongated members beyond a last resistor chip in the stack.

14. A resistance stack as claimed in claim 12, further comprising means including an aperture in said shell for injecting means consisting of insulation foam for insulating the resistor stack from mechanical shocks, and means including a second aperture in said shell for accommodating overflow of said insulation foam and for providing venting.

15. A resistance stack as claimed in claim 10, further comprising means including conformal coating on said shell for providing an environmentally protective shielding barrier.

16. A resistance stack as claimed in claim 15, further comprising a high temperature potting rubber-type compound filling a cavity beyond an end cap of said shell, said cavity being located between the end cap and the environmentally protective shielding barrier.

* * * * *